US010575552B2

(12) United States Patent
Guyard et al.

(10) Patent No.: US 10,575,552 B2
(45) Date of Patent: Mar. 3, 2020

(54) SMOKING ARTICLE HAVING A PARTICLE CONTAINING WRAPPER

(71) Applicant: PHILIP MORRIS PRODUCTS S.A., Neuchatel (CH)

(72) Inventors: Aurelien Guyard, Pompaples (CH); Ping Li, Lausanne (CH)

(73) Assignee: Philip Morris Products S.A., Neuchâtel (CH)

( * ) Notice: Subject to any disclaimer, the term of this patent is extended or adjusted under 35 U.S.C. 154(b) by 0 days.

(21) Appl. No.: 14/905,861

(22) PCT Filed: Jul. 15, 2014

(86) PCT No.: PCT/IB2014/063130
§ 371 (c)(1),
(2) Date: Jan. 18, 2016

(87) PCT Pub. No.: WO2015/008226
PCT Pub. Date: Jan. 22, 2015

(65) Prior Publication Data

US 2016/0150817 A1 Jun. 2, 2016

Related U.S. Application Data

(60) Provisional application No. 61/856,091, filed on Jul. 19, 2013.

(30) Foreign Application Priority Data

Jul. 19, 2013 (EP) ..... 13177177

(51) Int. Cl.
*A24D 1/02* (2006.01)
*A24D 1/00* (2020.01)

(52) U.S. Cl.
CPC ..... *A24D 1/02* (2013.01); *A24D 1/002* (2013.01)

(58) Field of Classification Search
CPC ..... A24B 1/00; A24B 15/24; A24B 15/283; A24B 15/285; A24B 15/288; A24D 1/02;
(Continued)

(56) References Cited

U.S. PATENT DOCUMENTS 4,450,847 A * 5/1984 Owens ..... A24D 1/02 131/331
5,105,836 A * 4/1992 Gentry ..... A24B 15/14 131/355

(Continued)

FOREIGN PATENT DOCUMENTS

CN 1407860 A 4/2003
CN 101623127 A 1/2010

(Continued)

OTHER PUBLICATIONS

International Search Report and Written Opinion for PCT/IB2014/063130 dated Mar. 4, 2015; 7 pgs.

(Continued)

*Primary Examiner* — Seyed Masoud Malekzadeh
*Assistant Examiner* — Taryn Trace Willett
(74) *Attorney, Agent, or Firm* — Mueting, Raasch & Gebhardt, P.A.

(57) ABSTRACT

A smoking article includes a tobacco rod and a wrapper disposed about the tobacco rod. The wrapper includes a plurality of aggregated particles. The aggregated particles include particles of functional material and a whitener bound in a polymeric binder. The particles of functional material may be a catalyst or an oxidant, such as an iron oxide-containing particle. The whitener may be calcium carbonate.

22 Claims, 3 Drawing Sheets

Figure 1:
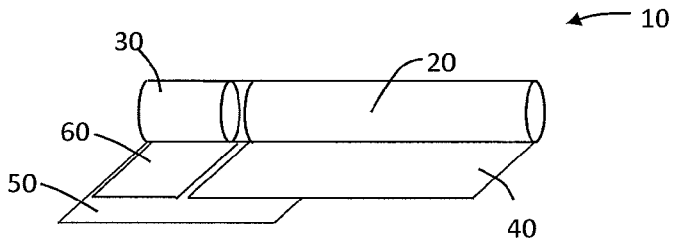

(58) Field of Classification Search
CPC ..... A24D 1/002; A24D 3/061; A24D 3/062; A24D 3/063; A24D 3/066; A24D 3/067; A24D 3/068; A24D 1/00
USPC ..... 131/105, 349, 358, 365
See application file for complete search history.

(56) References Cited

U.S. PATENT DOCUMENTS 5,109,876 A * 5/1992 Hayden ..... A24D 1/02 131/365
5,220,930 A * 6/1993 Gentry ..... A24B 15/282 131/331
5,386,838 A * 2/1995 Quincy, III ..... A24D 1/02 131/365
5,671,758 A * 9/1997 Rongved ..... A24B 15/28 131/331
6,476,112 B2 * 11/2002 Matsui ..... B01J 20/041 524/430
6,769,437 B2 8/2004 Hajaligol et al.
6,832,613 B2 12/2004 Brunbauer
7,165,553 B2 * 1/2007 Luan ..... A24B 15/28 131/334
2002/0157678 A1 * 10/2002 Hampl, Jr. ..... A24D 1/02 131/365
2002/0189625 A1 12/2002 Bushby et al.
2003/0013369 A1 * 1/2003 Soane ..... D06M 16/00 442/181
2003/0114298 A1 * 6/2003 Woodhead ..... A24D 1/02 502/302
2003/0131859 A1 * 7/2003 Li ..... A24B 15/28 131/364
2004/0020504 A1 * 2/2004 Snaidr ..... A24D 1/02 131/365
2004/0040566 A1 * 3/2004 Li ..... A24B 15/287 131/364
2004/0169786 A1 * 9/2004 Yamazaki ..... G02F 1/133305 349/61
2005/0000531 A1 * 1/2005 Shi ..... A24B 15/28 131/347
2005/0051185 A1 * 3/2005 Rasouli ..... A24B 15/28 131/365
2005/0250878 A1 * 11/2005 Moore ..... B29C 73/22 523/211
2006/0068019 A1 * 3/2006 Dalziel ..... A61K 9/1611 424/490
2007/0169786 A1 * 7/2007 Li ..... A24B 15/28 131/365
2007/0246054 A1 * 10/2007 Gedevanishvili .... A24B 15/286 131/284
2009/0269447 A1 * 10/2009 Brimmer ..... A23L 7/109 426/96
2012/0012124 A1 1/2012 Hampl, Jr. et al.
2015/0296874 A1 * 10/2015 Awty ..... B01J 13/04 131/337

FOREIGN PATENT DOCUMENTS

EP 1 635 658 B1 12/2007
EP 1 635 656 B1 7/2008
EP 1 427 300 B1 6/2009
EP 2 077 731 B1 8/2011
EP 2 351 495 A1 8/2011
KZ 3162 C 3/1996
KZ 14150 A 4/2004
RU 2477064 C2 3/2013
WO WO 2001/041590 A1 6/2001
WO WO 03/077687 A2 9/2003
WO WO 2009/001223 A2 12/2008

OTHER PUBLICATIONS

International Preliminary Report on Patentability for PCT/IB2014/063130, dated Jan. 28, 2016; 5 pgs.
Office Action from CN 201480040025.2, issued by the Chinese Patent Office dated Sep. 11, 2018, including English Translation; 20 pgs.

* cited by examiner

SMOKING ARTICLE HAVING A PARTICLE CONTAINING WRAPPER

This application is the § 371 U.S. National Stage of International Application No. PCT/IB2014/063130, filed 15 Jul. 2014, which claims the benefit of U.S. Provisional Application No. 61/856,091, filed 19 Jul. 2013 and European Application No. 13177177.6 filed 19 Jul. 2013, which are incorporated by reference herein in their entireties.

This disclosure relates to wrappers for smoking articles, where the wrapper contains a plurality of aggregated particles. This disclosure also relates to smoking articles having such a wrapper.

Combustible smoking articles, such as cigarettes, typically have shredded tobacco (usually in cut filler form) surrounded by a paper wrapper forming a tobacco rod. A cigarette is employed by a smoker by lighting one end of the cigarette and burning the tobacco rod. The smoker then receives mainstream smoke by drawing on the opposite end or mouth end of the cigarette, which typically contains a filter. The shredded tobacco can be a single type of tobacco or a blend of two or more types of tobacco.

Smoking articles may include one or more wrappers, which are usually formed from paper. Examples of such wrappers include cigarette paper which circumscribes the tobacco rod and tipping paper which attaches the filter to the tobacco rod. Typically, these wrappers are white and are visible to a consumer. As such, many consumers have come to expect that smoking articles, or certain portions of smoking articles, maintain a white appearance.

In some cases, it may be desirable to add a functional material to a wrapper for a smoking article, so that the functional material can interact with the smoke produced by combustion of the tobacco rod. By way of example, iron oxide particles may be added to smoking articles to reduce carbon monoxide levels in mainstream smoke. However, addition of such functional material (which has a natural dark colour) to wrappers for smoking articles, tends to result in discolouration of the wrapper. This can be undesirable for consumers who have come to expect that smoking articles, or certain portions of smoking articles, maintain a white appearance.

In some cases, to mask this discolouration, it has been proposed to include a second wrapper, which does not contain any functional material, around the outside of the wrapper containing the functional material. However, the use of such an additional wrapper may not sufficiently mask the discolouration of the underlying wrapper and may cause other issues, such as increased paper flavour in the smoke of the double wrapped smoking article relative to the expected flavour of a single wrapped smoking article.

The use functional material, such as catalyst or oxidant particles, can present challenges other than potential discolouration of a wrapper. For example, during smoking, semi-volatile or non-volatile combustion products such as tar can deposit on the particles of functional material and effectively prevent the particles of functional material from interacting with the smoke in the manner intended.

It would therefore be desirable to provide a wrapper for a smoking article, which contains functional material, without having any of the above drawbacks typically associated with such wrappers.

According to a first aspect of the present disclosure, there is provided a smoking article having a tobacco rod and a wrapper disposed about the tobacco rod. The wrapper includes a plurality of aggregated particles, with each aggregated particle containing particles of functional material, a whitener, and a polymeric binder. Each aggregated particle has an inner core containing at least some of the particles of functional material. At least some of the whitener is distributed on the outer surface of the inner core, and the polymeric binder binds the components of each aggregated particle together.

The inventors have shown that by providing a plurality of aggregated particles, with each aggregated particle having particles of functional material in its inner core, and a whitener distributed on the outer surface of the inner core, the particles of functional material can be at least partially obscured from the view of a consumer, without unduly affecting the ability of the functional material to interact with smoke produced by the smoking article. This can allow for a generally white wrapper to include particles of functional material, such as iron oxide-containing particles, which typically have a naturally dark colour, without unduly affecting the ability of the functional material to interact with smoke produced by the smoking article. Furthermore, this can avoid the need for double wrapping of the smoking article, and thus avoids undesirable increases in paper notes during smoking and undesired complexity in the manufacturing process for the smoking article. These and other advantages will be readily understood by those of skill in the art upon reading the disclosure presented herein.

As used herein, "functional material" means material, which captures or converts components of the smoke from the smoking article or release flavour materials into the smoke produced by the smoking article. Such functional materials include, for example, sorbents, catalysts and flavourant materials.

Preferably, the functional material includes a catalyst or oxidant which is capable of removing or converting a component of the mainstream smoke during smoking of the smoking article. For example, the functional material may include a metal oxide, such as iron-oxide, copper oxide, titanium dioxide or cerium oxide. A particularly preferred functional material is iron oxide-containing particles, which facilitate the conversion of carbon monoxide to carbon dioxide or are converted, upon heating, to particles that can facilitate the conversion of carbon monoxide to carbon dioxide. Examples of such particles include iron oxide ($Fe_2O_3$) particles, iron oxyhydroxide (FeOOH) particles, similar particles, and combinations of such particles.

Preferably, the particles of functional material have an average size of from about 0.1 micrometers to about 6 micrometers. Even more preferably, the particles of functional material have an average size of from about 0.1 micrometers to about 2 micrometers. In one preferred embodiment, the particles of functional material have an average size of about 1 micrometer.

Any suitable whitener may be used in accordance with the teachings presented in this disclosure. For example, suitable whiteners that may be bound to particles of functional material by the polymeric binder include calcium carbonate ($CaCO_3$), titanium dioxide ($TiO_2$), zinc oxide (ZnO), barium sulfate ($BaSO_4$), talc, clay, other similar whiteners, and combinations of such whiteners. However, preferably, the whitener comprises calcium carbonate. Calcium carbonate is well known and widely used in the manufacture of wrappers for smoking articles. Therefore, calcium carbonate is a particularly preferred whitener for the present invention as it may provide the aggregated particles with the same or similar external properties as those particles normally used in the manufacture of wrappers for smoking articles.

Preferably, the whitener is provided in the form of nanoparticles. That is, preferably the whitener includes particles having an average size of about 950 nanometers or less. Typically, the nanoparticles will have an average size of about 1 nanometer or greater. Preferably, the nanoparticles have an average size of from about 20 nanometers to about 500 nanometers. For example, the nanoparticles may have an average size from about 40 nanometers to about 100 nanometers, such as about 70 nanometers. Without wishing to be bound by theory, it is thought that the use of such small nano-scale whitener particles increases the likelihood of the aggregated particles having the majority of the particles of functional material located in the inner core of each aggregated particle, and the majority of the whitener particles located on the surface of the inner core of each aggregated particle.

Preferably, at least some of the whitener forms a porous coating on the inner core of each aggregated particle, so that the particles of functional material in the inner core can interact with components of smoke produced by the smoking article. An example of a porous whitener is calcium carbonate.

The whitener may consist of whitener particles having an average size of less than about 30% of the average size of the particles of functional material. Preferably, the whitener particles have average size of less than about 15% of the average size of the particles of functional material, even more preferably less than about 10% of the average size of the particles of functional material. In one preferred embodiment, the whitener particles have average size of about 7% of the average size of the particles of functional material. Without wishing to be bound by theory, it is thought that the use of particles having such ratios increases the likelihood of the aggregated particles having the majority of the particles of functional material located in the inner core of each aggregated particle, and the majority of the whitener particles located on the surface of the inner core of each aggregated particle.

Preferably, the aggregated particles have an average size of about 0.5 micrometers to about 10 micrometers. In particularly preferred embodiments, the plurality of aggregated particles have an average size of from about 1 micrometer to about 5 micrometers, even more preferably from about 1 micrometer to about 3 micrometers. In one preferred embodiment the plurality of aggregated particles have an average size of about 2 micrometers. Such sizes are comparable to the average particle size of standard filler particles, such as calcium carbonate particles, which are typically used as a filler material in the manufacture of wrappers for smoking articles. This therefore enables the plurality of aggregated particles to be incorporated into the smoking article wrapper with conventional processes and machinery. Furthermore, this also enables standard filler particles, such as calcium carbonate particles, or a portion thereof, to be readily replaced by the aggregated particles without adding significant complexity to the wrapper making process.

Preferably, the aggregated particles form between about 10% and 40% by weight of the wrapper, even more preferably about 30% by weight of the wrapper. This corresponds to the amount of filler material typically used for smoking article wrappers.

The aggregated particles may include any suitable weight ratio of particles of functional material, whitener, and polymeric binder. If the particles of functional material are a catalyst or oxidant, the ratio of particles of functional material, whitener and polymeric binder is preferably tuned to allow for sufficient functional activity of the particles of functional material. Preferably a balance is struck in the ratio of whitener to particles of functional material to achieve desired whiteness while maintaining functional activity.

For example, the weight ratio of the particles of functional material to whitener is from about 1:2 to about 1:10. Such weight ratios may be effective, for example, to maintain activity of iron oxide particles. Preferably, the weight ratio of the particles of functional material to whitener is from about 1:3 to about 1:7. As indicated by the Examples provided below, such weight ratios can be effective at maintaining an acceptable activity of iron oxide particles or other functionality of other functional materials, whilst maintaining an acceptable white appearance.

The aggregated particles may have weight ratios of particles of functional material to polymeric binder to whitener of from about 1:1:2 to about 1:1:10. Preferably, aggregated particles have weight ratios of particles of functional material to polymeric binder to whitener of from about 1:1:3 to about 1:1:7. As indicated by the Examples provided below, such weight ratios can be effective at maintaining an acceptable activity of iron oxide particles or other functionality of other functional materials, whilst maintaining an acceptable white appearance.

Any suitable polymeric binder may be used to bind the particles of functional material and the whitener into a plurality of aggregated particles. When the particles of functional material include a catalyst or oxidant, such as an iron oxide-containing particle, the polymeric binder preferably decomposes, evaporates or otherwise exposes the previously bound catalyst or oxidant upon heating at a temperature achieved during smoking but not at temperature achieved during storage. For example, the polymeric binder may decompose, evaporate or otherwise expose the previously bound catalyst or oxidant when exposed to temperatures of about 100° C. or greater, but not when exposed to temperature of less than about 100° C. Preferably, the polymeric binder decomposes, evaporates or otherwise exposes the previously bound catalyst or oxidant when exposed to temperatures of about 200° C. or greater but not when exposed to temperatures of less than about 200° C. More preferably, the polymeric binder decomposes, evaporates or otherwise exposes the catalyst or oxidant when exposed to temperature of about 250° C. or greater, but not when exposed to temperatures less than about 250° C. Typically, the polymeric binder decomposes, evaporates or exposes the catalyst or oxidant when exposed to temperature of about 500° C. or less.

Preferably, only upon heating of the aggregated particles during smoking are the catalysts or oxidants exposed to the area of combustion of the smoking article. This limits potential visibility of the particles of functional material to only those areas achieving the necessary temperatures during smoking.

When the polymeric binder binds particles of functional material that includes a catalyst, oxidant or other functional material for which it is desired to expose the material to smoke, the polymeric binder preferably prevents or reduces deposition of smoke constituents onto the particles to prevent or reduce effective deactivation of the particles by deposition of the smoke constituents.

In embodiments, the polymeric binder is permeable to mainstream smoke. In such embodiments, the polymeric binder need not decompose, evaporate or otherwise expose the particles of functional material, particularly when the material is a catalyst, oxidant or other functional material, at temperatures achieved during smoking.

Examples of polymeric binders that may be used to bind the particles of functional material and the whitener into a plurality of aggregated particles include celluloses, starches, starch-based polymers, waxes, polyvinylalcohols, polyethylene oxides, polyesters, alginates, pectins and the like. Preferably, the polymeric binder is a starch or starch-based polymers. For example, the polymeric binder may be a native potato starch.

The plurality of aggregated particles may be formed in any suitable manner. For example, the aggregated particles may be formed by drying, dissolving, or suspending particles of functional material, whitener, polymeric binder, and any other components in a solvent or other suitable liquid and drying to remove the solvent or liquid. In such cases, the solvent or liquid is preferably an aqueous solvent or an aqueous liquid. As used herein, "aqueous" means comprising about 50% or more water, preferably 75% or more water, more preferably 90% or more water. Of course, non-aqueous solvents or liquids may be used. For example, alcohol-based solvents or liquids, such as ethanol-based solvents or liquids, may be used.

Preferably drying comprises spray drying. Natural polymeric binders such as cellulose and starch based materials are preferably used when spray drying processes are employed.

In preferred embodiments, a flocculated feed of a slurry comprising particles of functional material, whitener, polymeric binder, and solvent or liquid is used to generate the aggregated particles. It is believed that the flocculated feed results in higher concentration of whitener on the surface than feeds that are previously homogenized, which may result in higher concentrations of particles of functional material on the surface.

Aggregated particles may be applied to a paper component of a smoking article in any suitable manner. As used herein, a "paper component of a smoking article" includes precursors of paper components for smoking articles, such as sheets or webs of paper prior to being cut for incorporation into a smoking article. Paper components of smoking articles include, but are not limited to, cigarette paper or precursor sheets of cigarette paper, plug wrap or precursor sheets of plug wrap, and tipping paper or precursor sheets of tipping paper.

In embodiments, aggregated particles are coated on a paper component of a smoking article. Aggregated particles may be dissolved or suspended and coated onto a surface of a paper substrate, which may be a wet or dry based web, by printing, spraying, rolling, or other suitable coating technique. The coating may be applied to the inner surface of the paper component, the outer surface of the paper component, or both the inner and outer surfaces of the paper component. Preferably the coating is applied to the inner surface of the paper component, particularly when the particles of functional material included in the aggregated particle is a catalyst. As used herein, an inner surface of a paper component is the surface of the paper component that faces the longitudinal axis of the smoking article when incorporated into the smoking article.

A coating of aggregated particles may be applied to a paper component of a smoking article at any suitable thickness. For example, a coating of aggregated particles may have a thickness from about 0.05 micrometers to about 2 micrometers. Preferably, a coating of aggregated particles has a thickness of at least about 1 micrometer.

Preferably, aggregated particles are incorporated into a paper component of a smoking article as filler during the papermaking process. In embodiments, aggregated particles replace part of all of calcium carbonate filler typically used as a filler in the papermaking process. Aggregated particle sizes of about 10 micrometers or less allows for ready substitution for calcium carbonate particles. The use of nanoscale whitener, such as calcium carbonate nanoparticles, may facilitate keeping the average size of the aggregated particles to about 10 micrometers or less.

According to a second aspect of this disclosure, there is provided a method of forming a wrapper containing a plurality of aggregated particles. The method includes the steps of binding particles of functional material and a whitener in a polymeric binder to produce a plurality of aggregated particles, each aggregated particle having an inner core containing at least some of the particles of functional material, with at least some of the whitener distributed on the outer surface of the inner core; and contacting a substrate of a wrapper of a smoking article with the plurality of aggregated particles.

According to a third aspect of this disclosure, there is provided a wrapper for a smoking article, the wrapper includes a plurality of aggregated particles, with each aggregated particle containing particles of functional material, a whitener, and a polymeric binder. Each aggregated particle has an inner core containing at least some of the particles of functional material. At least some of the whitener is distributed on the outer surface of the inner core, and the polymeric binder binds the components of each aggregated particle together.

It will be understood that any of the features described above in respect of the first aspect of this disclosure may be equally applicable to the above mentioned second and third aspects of this disclosure in isolation or in combination with each other.

It will be appreciated that, in some embodiments, each aggregated particle may include some particles of functional material outside of its inner core. However, preferably, each such aggregated particle includes less particles of functional material outside of its inner core than particles of functional material within its inner core.

Alternatively or additionally, it will be appreciated that, in some embodiments, each aggregated particle may include some whitener within its inner core. However, preferably, each such aggregated particle includes less whitener within its inner core than whitener outside of its inner core, such as on the surface of its inner core.

Preferably, the wrapper having the plurality of aggregated particles is a white wrapper. For purposes of the present disclosure, a "white" wrapper is a wrapper that has a brightness of about 35% or greater as determined by method ISO 2470-1:2009: "Paper, board and pulps—Measurement of diffuse blue reflectance factor—Part 1: Indoor daylight conditions (ISO brightness)." Preferably, the wrapper has an ISO brightness of about 40% or more. More preferably, the wrapper has an ISO brightness of about 45% or more. Even more preferably, the wrapper has an ISO brightness of about 50% or more. Typically, the wrapper has an ISO brightness of about 90% or less.

All scientific and technical terms used herein have meanings commonly used in the art unless otherwise specified. The definitions provided herein are to facilitate understanding of certain terms used frequently herein.

As used herein, the singular forms "a", "an", and "the" encompass embodiments having plural referents, unless the content clearly dictates otherwise.

As used herein, "or" is generally employed in its sense including "and/or" unless the content clearly dictates otherwise. The term "and/or" means one or all of the listed elements or a combination of any two or more of the listed elements.

As used herein, "have", "having", "include", "including", "comprise", "comprising" or the like are used in their open ended sense, and generally mean "including, but not limited to". It will be understood that "consisting essentially of", "consisting of", and the like are subsumed in "comprising," and the like.

As used herein, the term "particle size" refers to the largest cross sectional dimension of an individual particle within the particulate material. The "average" particle size refers to the arithmetic mean particle size for the particles. The particle size distribution for a sample of particulate material may be determined using a known sieve test.

The words "preferred" and "preferably" refer to embodiments of the invention that may afford certain benefits, under certain circumstances. However, other embodiments may also be preferred, under the same or other circumstances. Furthermore, the recitation of one or more preferred embodiments does not imply that other embodiments are not useful, and is not intended to exclude other embodiments from the scope of the disclosure, including the claims.

Any compound or particle described in this disclosure includes any hydrate, solvate, or polymorph of the compound or particle. For example, as used herein "iron oxyhydroxide" includes hydrated and non-hydrated forms of iron oxyhydroxide.

The invention will now be further described with reference to the figures in which:

FIG. 1 is a schematic perspective view of an embodiment of a partially unrolled smoking article. The smoking article depicted in FIG. 1 illustrates an embodiment of a smoking article or components of a smoking article described above); and FIG. 2 is a schematic drawing of an aggregated particle described above. The schematic drawings are not necessarily to scale and are presented for purposes of illustration and not limitation. The drawing depicts one or more aspects described in this disclosure. However, it will be understood that other aspects not depicted in the drawing fall within the scope and spirit of this disclosure.

Referring now to FIG. 1, a smoking article 10, in this case a cigarette, is depicted. The smoking article 10 includes a rod 20, such as a tobacco rod, and a mouth end filter segment 30. The depicted smoking article 10 includes wrappers as paper components, which include plug wrap 60, cigarette paper 40, and tipping paper 50, to which aggregated particles described above may be applied. In the depicted embodiment, the plug wrap 60 circumscribes at least a portion of the filter segment 30. The cigarette paper 40 circumscribes at least a portion of the rod 20. Tipping paper 50 or other suitable wrapper circumscribes the plug wrap 60 and a portion of the cigarette paper 40 as is generally known in the art. Preferably, aggregated particles described above are applied to the cigarette paper 40, which is typically white.

Figure 2:
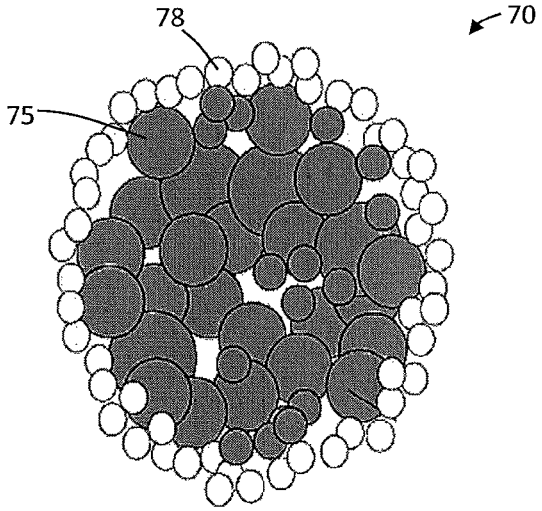

FIG. 2 illustrates an aggregated particle in accordance with the present invention. As can be seen from FIG. 2, the aggregated particle 70 includes particles of functional material, in this case iron oxyhydroxide particles, 75 in the inner core of the aggregated particle 70, and whitener particles, in this case calcium carbonate particles, 78 on the surface of the inner core of the aggregated particle. Although not shown, a polymeric binder binds the calcium carbonate particles 78 and the iron oxyhydroxide particles 75 into the aggregated particle.

Non-limiting examples illustrating aggregated particles that include particles of functional material and a whitener bound in a polymeric binder and incorporation of aggregated particles into a wrapper, such as cigarette paper, of a smoking article are described below.

EXAMPLES

In the following examples, aggregated particles include iron oxyhydroxide (FeOOH) as particles of functional material, calcium carbonate ($CaCO_3$) particles as whitener particles and native potato starch as the polymeric binder. One of skill in the art will understand that the concepts shown in the following examples may readily be applied to other particles of functional material, other whiteners, and other polymeric binders.

In one example, aggregated particles were formed by mixing iron oxyhydroxide particles, calcium carbonate particles (MULTIFEX—MM, Ultrafine/Nano Uncoated Precipitated Calcium Carbonate from Specialty Minerals) and potato starch in water and spray drying. The calcium carbonate particle had an average size of about 70 nanometers. Milling of granular and commercial grade of oxyhydroxide particles was performed to produce particles with target size of 1-2 microns, suitable for inclusion in the aggregated particles. Iron oxyhydroxide particles with a starting granule size of 30-50 mesh were used for this purpose. Dry and wet milling treatments were used to refine the FeOOH granules but wet milling procedure is preferred. After 15 minutes of wet milling treatment a d90 diameter of 1.16 microns was obtained.

Figure 3:
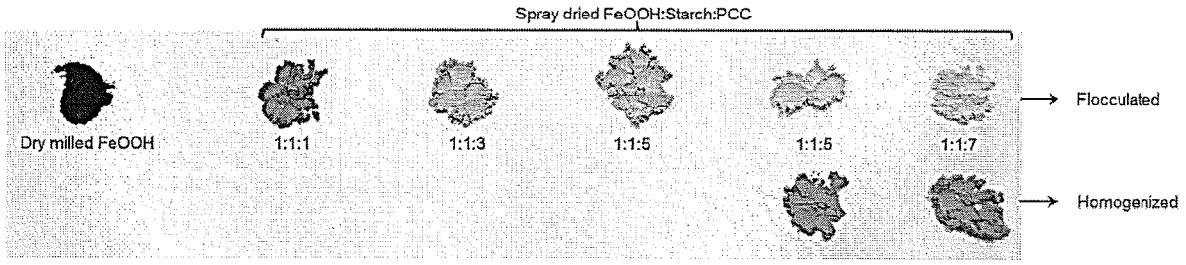

Various ratios of the iron oxyhydroxide particles, the calcium carbonate particles and potato starch were mixed and dried. Images of resulting aggregated particles are shown in FIG. 3, which show aggregated particles resulting from weight ratios of FeOOH particles to starch to calcium carbonate of 1:1:1, 1:1:3, 1:1:5, and 1:1:7. The calcium carbonate particles had an average size of about 70 nanometers. The FeOOH particles were dry milled particles having an average size of about 1 micrometer. Aggregated particles obtained from flocculant and homogenized processes were obtained.

As shown in FIG. 3, increased amounts of calcium carbonate resulted in increased whiteness of the particles. Of course the amount of calcium carbonate or other whitener that could be added in the mixture is preferably as low as possible to maintain the ratio of iron oxyhydroxide (or other functional material)/calcium carbonate (or other whitener) high enough to maintain an acceptable functional or catalytic activity after the aggregated particles have been formed.

As also shown in FIG. 3, the process or mechanical load of slurry mixing may affect the whiteness of the resulting aggregated particles, with flocculated particles appearing more white than homogenized particles. Without wishing to be bound by theory, this is believed to be due, at least in part, to the fact that the flocculated feed is lighter than the homogenized. Without prior homogenization of the slurry before spray drying process, calcium carbonate particles will flocculate onto the surface of catalyst particle while the polymeric binder will bind calcium carbonate together and not coat them. As a consequence, the powder of aggregated particles will be lighter. Homogenized feed produces a higher relative amount of oxyhydroxide particles on the aggregate surface than the initially flocculated feed and the powder of aggregated particles appears to be darker. Because flocculated particles appear whiter than homogenized particles, it may be advantageous to employ flocculated feeds, as this may allow higher ratios of functional material to whitener, which can result in greater functional activity while maintaining whiteness.

Electron microscopy techniques and thermogravimetry analysis indicated that iron oxyhydroxide particles were located within the inner core of an aggregated particle and that nanoscale calcium carbonate particles were located on the outer surface of the inner core of the aggregated particle (data not shown).

Experiments were conducted to test the catalytic activity of iron oxyhydroxide particles bound by starch with calcium carbonate particles into a plurality of aggregated particles, compared to that of dry milled FeOOH powder.

Briefly, a powdered sample of FeOOH particles (Sample A), and an equally sized powdered sample of aggregated particles consisting of calcium carbonate particles with an average size of about 70 nanometers, FeOOH particles with an average size of about 1 micrometer, and native potato starch in a ratio of 5:1:1 (Sample B), were separately tested in a quartz glass tube. The samples were located between layers of quartz wool within the tube. The tube had an internal diameter of 9 mm, an external diameter of 12.5 mm and a length of 500 mm. The 300 mm long central part of the tube was located within an electrically heated oven.

Figure 4:
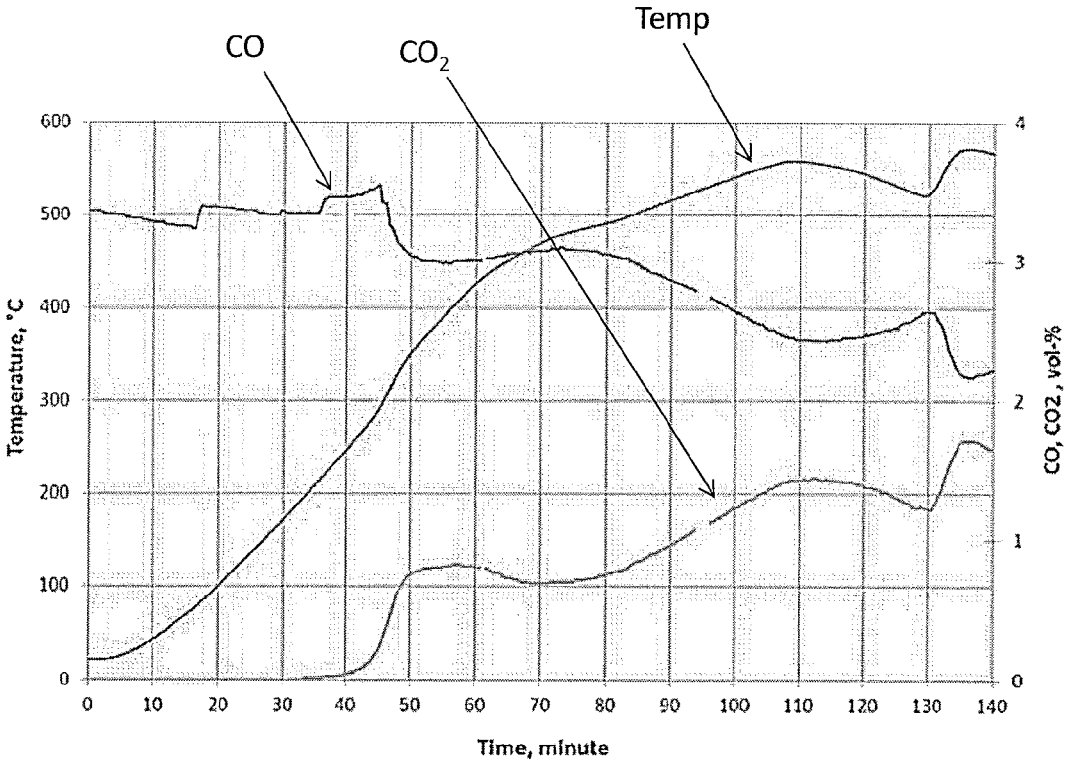
Figure 5:
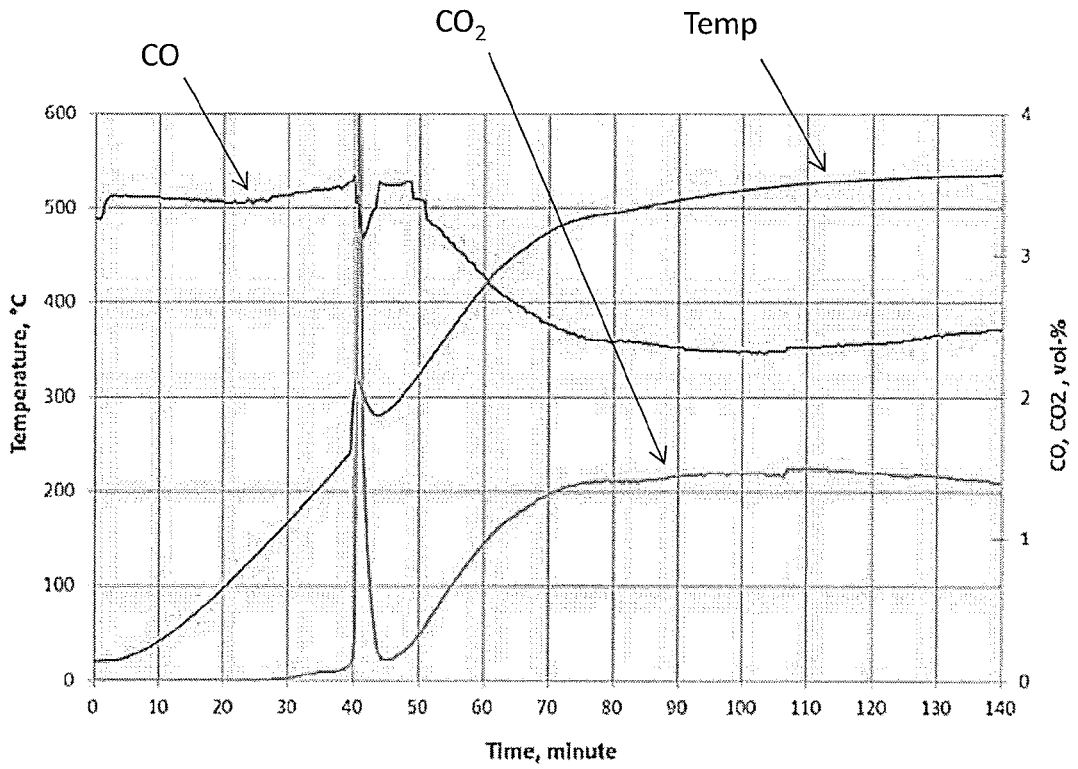

Carbon monoxide gas was passed through the tube at a rate of 1000 milliliters/minute, and an online gas analysis was conducted with a Gasmet FT-IR to determine the level of carbon dioxide produced. The gas analysis for Sample A is shown in FIG. 4 and the gas analysis for Sample B is shown in FIG. 5.

The experiments revealed that that the catalytic activity of the iron oxyhydroxide particles in the aggregated particles of Sample B was comparable to (and in some cases better than) the catalytic activity of the standard iron oxyhydroxide particles of Sample A.

A summary of results for catalytic activity is presented in Table 1 below, wherein 1:1:5 and 1:1:3 represent the weigh ratios of iron oxyhydroxide to starch to calcium carbonate.

TABLE 1

Catalytic activity of various powder compositions

| | Total sample amount in reactor tube (mg) | Amount of active catalyst (mg) | Incoming CO (vol. %) | Out-coming CO (vol. %) | Out-coming $CO_2$ (vol. %) | % reduction |
|---|---|---|---|---|---|---|
| PCC | 155 | 0 | 3.4 | 3.2 | 0.3 | 6 |
| Starch | 50 | 0 | | 3.4 | 0.02 | 0 |
| FeOOH | 53 | 50 | | 2.75 | 1.2 | 20 |
| FeOOH 1:1:5 | 350 | 50 | | 2.50 | 1.4 | 26 |
| FeOOH 1:1:3 | 250 | 50 | | 2.80 | 0.9 | 18 |

Aggregated particles described above were incorporated in cigarette wrapper through conventional papermaking processes. Aggregated particles replaced calcium carbonate as filler in the papermaking process. Calcium carbonate typically is incorporated into cigarette paper as filler at 30% by weight of the paper and typically has an average particle size of about 2 micrometers (1.9 micrometers in this example). Accordingly, in this example, aggregated particles were incorporated as filler in an amount of 30% by weight of the paper. Aggregated particles formed from 1:1:3 and 1:1:5 weight ratios of iron oxyhydroxide to starch to calcium carbonate (as described above) were used. Whiteness of such paper was compared to typical cigarette paper that included 30% calcium carbonate particles (1.9 micrometer particles), as well as to paper in which aggregated, iron oxyhydroxide-containing, particles (milled as described above) replaced a portion of the calcium carbonate particle filler (15 wt % calcium carbonate, 15 wt % iron oxyhydroxide in one case and 24 wt % calcium carbonate, 6 wt % in another case).

Figure 6:
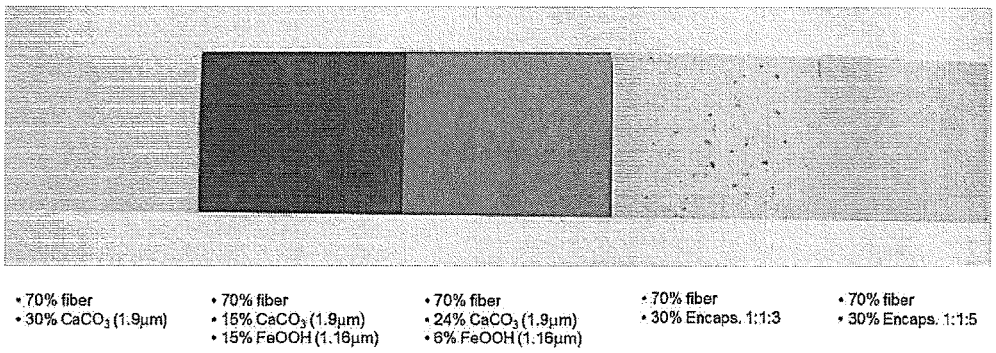

Images of the resulting paper are shown in FIG. 6, which from right to left are (i) conventional cigarette paper (30 wt % calcium carbonate); (ii) cigarette paper including 15 wt % calcium carbonate and 15 wt % standard iron oxyhydroxide; (iii) cigarette paper including 24 wt % calcium carbonate and 6 wt % standard iron oxyhydroxide; (iv) cigarette paper including 30 wt % aggregated particles (1:1:3); and (v) cigarette paper including 30 wt % aggregated particles (1:1:5). As shown in FIG. 6, incorporation of even small amounts (4 wt %) of standard iron oxyhydroxide particles resulted in significant discolouration of the paper, while incorporation of aggregated particles containing iron oxyhydroxide particles resulted in a more white appearance.

According to ISO brightness testing, the conventional cigarette paper had a brightness of about 88%. Incorporation of standard iron oxyhydroxide particles dropped the ISO brightness down to about 20%. When the cigarette paper included the aggregated particles, ISO brightnesses of up to about 50% was obtained.

In light of the above, aggregated particles containing particles of functional material can be incorporated into cigarette wrapper through conventional papermaking process while strongly masking the color of the particles of functional material, and without unduly affecting the ability of the functional material to interact with smoke produced by the smoking article. It also appears that the aggregated particles can replace all or a portion of particles, such as calcium carbonate particles, which are typically used in conventional cigarette base paper as filler compounds.

The invention claimed is:

1. A smoking article comprising:

a tobacco rod; and a wrapper disposed about the tobacco rod, the wrapper comprising a plurality of aggregated particles, each aggregated particle comprising particles of functional material, a whitener, and a polymeric binder, wherein the aggregated particles are prepared by flocculating particles of functional material, whitener, and polymeric binder, wherein the polymeric binder binds together the functional material and whitener in each particle, wherein each aggregated particle has an inner core comprising at least some of the particles of functional material, and wherein at least some of the whitener is distributed on an outer surface of the inner core.

2. A smoking article according to claim 1, wherein the whitener forms a porous coating on the inner core of each aggregated particle, so that the particles of functional material in the inner core can interact with components of smoke produced by the smoking article.

3. A smoking article according to claim 1, wherein the average size of the plurality of aggregated particles is from 0.5 micrometers to 10 micrometers.

4. A smoking article according to claim 1, wherein the average size of the particles of functional material is from 0.1 micrometers to 6 micrometers.

5. A smoking article according to claim 1, wherein the whitener comprises whitener particles having an average size of 950 nanometers or less.

6. A smoking article according to claim 1, wherein the whitener comprises whitener particles having an average size of less than 30% of the average size of the particles of functional material.

7. A smoking article according to claim 1, wherein the functional material comprises a catalyst material.

8. A smoking article according to claim 7, wherein the catalyst material comprises a metal oxide.

9. A smoking article according to claim 1, wherein the whitener comprises calcium carbonate particles.

10. A smoking article according to claim 1, wherein the at least one aggregated particle comprises a weight ratio of functional material to whitener of from 1:3 to 1:7.

11. A smoking article according to claim 1, wherein the wrapper comprises a paper web and a filler and wherein the filler comprises the plurality of aggregated particles.

12. A smoking article according to claim 1, wherein the wrapper comprises a substrate and the plurality of aggregated particles are disposed on the substrate.

13. A method comprising:

binding particles of functional material and a whitener in a polymeric binder to produce a plurality of aggregated particles comprising the particles of functional material and whitener bound together by the polymeric binder, wherein producing the plurality of aggregated particles comprises flocculating the particles of functional material, whitener, and polymeric binder, each aggregated particle having an inner core comprising at least some of the particles of functional material, with at least some of the whitener distributed on an outer surface of the inner core, and contacting a substrate of a wrapper of a smoking article with the plurality of aggregated particles.

14. A wrapper for a smoking article, the wrapper comprising:

a plurality of aggregated particles, each aggregated particle comprising particles of functional material, a whitener, and a polymeric binder, wherein the aggregated particles are prepared by flocculating particles of functional material, whitener, and polymeric binder, wherein the polymeric binder binds together the functional material and whitener in each particle, wherein each aggregated particle has an inner core comprising at least some of the particles of functional material, and wherein at least some of the whitener is distributed on an outer surface of the inner core.

15. A smoking article according to claim 14, wherein the whitener comprises whitener particles having an average size of less than 30% of the average size of the particles of functional material.

16. A smoking article according to claim 14, wherein the at least one aggregated particle comprises a weight ratio of functional material to whitener of from 1:3 to 1:7.

17. A smoking article according to claim 13, wherein the at least one aggregated particle comprises a weight ratio of functional material to whitener of from 1:3 to 1:7.

18. A smoking article according to claim 1, wherein the at least one aggregated particle comprises a weight ratio of functional material to polymeric binder to whitener of from 1:1:1 to 1:1:7.

19. The method of claim 13, wherein producing the plurality of aggregated particles comprises mixing the particles of functional material, whitener, and polymeric binder together.

20. A smoking article according to claim 14, wherein the average size of the plurality of aggregated particles is from 0.5 micrometers to 10 micrometers.

21. A method according to claim 13, wherein contacting the substrate with the aggregated particles comprises incorporating the aggregated particles into the substrate as a filler.

22. A smoking article according to claim 14, wherein the average size of the particles of functional material is from 0.1 micrometers to 6 micrometers.

* * * * *